United States Patent [19]

Ogihara

[11] 4,305,330

[45] Dec. 15, 1981

[54] PRESSURE APPLICATION TYPE IMAGE FIXING METHOD AND IMAGE FIXING APPARATUS THEREFOR

[75] Inventor: Masato Ogihara, Sagamihara, Japan

[73] Assignee: Ricoh Company, Ltd., Tokyo, Japan

[21] Appl. No.: 108,817

[22] Filed: Dec. 31, 1979

[30] Foreign Application Priority Data

Dec. 30, 1978 [JP] Japan ..... 53-165053

[51] Int. Cl.[3] ..... B30B 3/02

[52] U.S. Cl. ..... 100/35; 100/156; 100/210; 118/120; 430/98

[58] Field of Search ..... 100/35, 156, 210; 68/105; 101/250, 269; 432/60, 228; 355/3 FU; 118/60, 112, 120; 430/98, 99, 124; 219/216

[56] References Cited

U.S. PATENT DOCUMENTS

| | | | |
|---|---|---|---|
| 434,451 | 8/1890 | Madsen | 100/210 |
| 730,368 | 6/1903 | Hampp | 100/210 |
| 1,933,022 | 10/1933 | Meeker | 100/156 X |
| 4,057,013 | 11/1977 | Asano | 101/269 X |

*Primary Examiner*—Peter Feldman

*Attorney, Agent, or Firm*—Oblon, Fisher, Spivak, McClelland & Maier

[57] ABSTRACT

In a pressure application type image fixing method and apparatus for applying a predetermined pressure to a developed image on a recording medium, a pressure application means for fixing the image to the recording medium is reciprocated in the direction normal to the moving direction of the recording medium and the image fixing is performed by moving both the recording medium and the pressure application means, and rollers and spring means are employed as the pressure application means.

6 Claims, 4 Drawing Figures

PRESSURE APPLICATION TYPE IMAGE FIXING METHOD AND IMAGE FIXING APPARATUS THEREFOR

BACKGROUND OF THE INVENTION

The present invention relates to an image fixing method of fixing image on a recording medium by applying a predetermined pressure to a developed image formed on the recording medium and an apparatus therefor, which is suitable for use in a facsimile apparatus or the like.

Conventionally, in order to fix an image developed by a dry type development apparatus to a recording medium, with application of a predetermined pressure to the developed image, two calender rollers are disposed so as to be in pressure contact with each other in the direction normal to the movement direction of the recording medium and the recording medium is caused to pass between the two rollers.

In order to obtain a good fixed image by this method, it is necessary to apply a pressure as great as about 700 to 800 kg in total uniformly to the recording medium in the direction of the width thereof, that is, in the direction normal to the movement direction of the recording medium and calender rollers with a diameter as great as 60 to 70 mm are required and the calender rollers have to be in pressure contact with each other, with the axes thereof relatively shifted.

Therefore, the image fixing apparatus of this type tends to become over-sized and over-weighted, so that a great driving force is required for driving the calender rollers and therefore a drive apparatus for driving the calender rollers also tends to become over-sized.

In order to prevent the image fixing apparatus of the above-mentioned type from becoming over-sized, in another conventional image fixing apparatus an auxiliary roller is additionally attached to the two calender rollers to that and it is tried to increase the pressure between the two calender rollers by the auxiliary roller.

According to this method, it becomes unnecessary to use the calender rollers having such a great diameter and consequently the driving force required for driving the calender rollers can be reduced to some extent. However, it requires three rollers and the image fixing apparatus still tends to become over-sized and over-weighted and the size of the roller drive apparatus cannot be reduced so much.

Furthermore, in any of the above-mentioned conventional image fixing apparatuses, pressure always has to be applied uniformly in the direction of the width of the recording medium and accordingly the surface of each calender roller has to be finished accurately. Even if the surface of each calender roller were finished so accurately, when assembling the calender rollers, a high assembling accuracy and a fine adjustment of the image fixing apparatus are required so as to set the space between the two calender rollers uniformly and accurately. Otherwise, the recording medium is wrinkled when the recording medium is caused to pass through the calender rollers. This will reduce the operation efficiency and accordingly a high cost is required.

SUMMARY OF THE INVENTION

It is therefore an object of the present invention to provide a low-cost pressure image fixing method and apparatus therefor in which the shortcomings of the conventional methods and apparatuses are eliminated so that the image fixing apparatus and the drive apparatus thereof are made compact in size and lighter in weight.

In order to attain this object, in the present invention, there is provided a pressure application means for applying pressure to the recording medium, which can be reciprocated in the direction almost normal to the moving direction of the recording medium, while the recording medium is moved, thus performing image fixing.

According to the present invention, the image fixing apparatus and the driving apparatus for reciprocating the pressure application means are made compact in size and light in weight, and uniform and excellent image fixing is performed.

BRIEF DESCRIPTION OF THE DRAWINGS

For a better understanding of the invention as well as the objects and other features thereof, reference will be had to the following detailed description which is to be read in conjunction with the drawings wherein.

DETAILED DESCRIPTION OF THE PREFERRED EMBODIMENT

Figure 1:
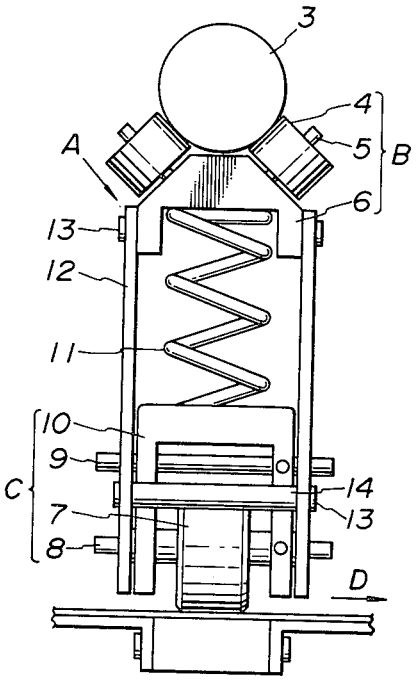
FIG. 1 is a schematic side view of an embodiment of an image fixing apparatus according to the present invention.
Figure 2:
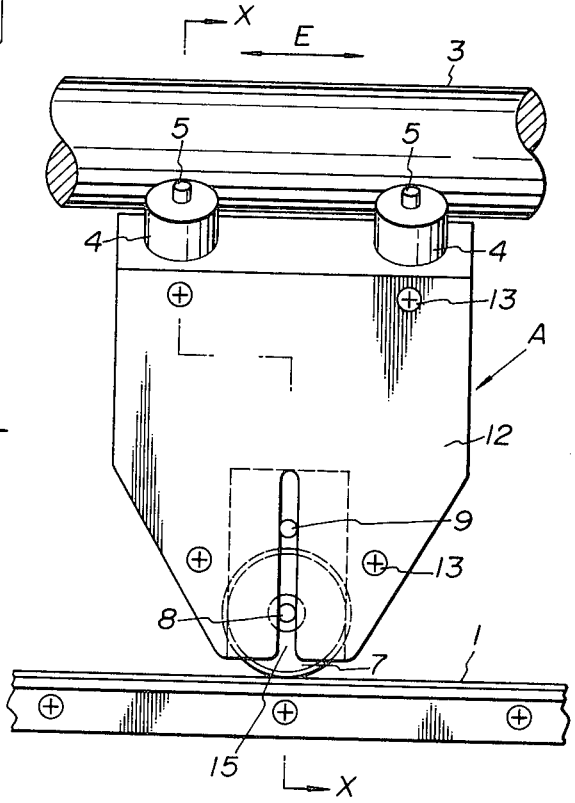
FIG. 2 is a schematic plan view of the embodiment of FIG. 1.
Figure 3:
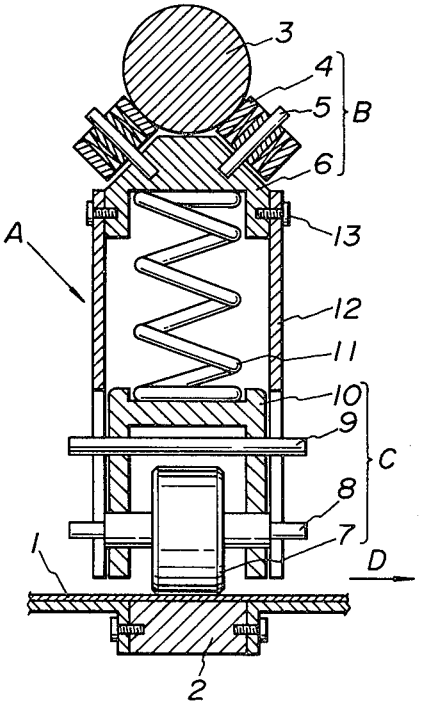
FIG. 3 is a section taken on line X—X in FIG. 2.

Referring to FIG. 1, FIG. 2 and FIG. 3, there is shown the construction of an image fixing unit A for use in the present invention. FIG. 1 is a schematic side view of the image fixing apparatus and FIG. 2 is a schematic plan view of the image fixing apparatus of FIG. 1, and FIG. 3 is a section taken on line X—X in FIG. 2.

The image fixing unit A is disposed between an image fixing bar 2 which is disposed in the direction almost normal to the moving direction of a recording medium 1 and a guide bar 3 which is disposed above and parallel to the image fixing bar 2 as shown in FIG. 1 through FIG. 3.

The image fixing unit A comprises a pair of guide blocks B for moving the image fixing unit A along the guide bar 3 and an image fixing block C for applying a predetermined pressure to a recording medium 1 on the image fixing bar 2.

Each guide block B comprises guide rollers 4 which are rotated in contact with the guide bar 3, shafts 5 which support the guide rollers 4 in such a manner that the guide rollers 4 are rotatable on the shafts 5 and a support member 6 to which the shafts 5 are fixed.

The image fixing block C comprises an image fixing roller 7 which is moved rotatably on the image fixing bar 2, a shaft 8 which supports the image fixing roller 7 in such a manner that the image fixing roller 7 is rotable on the shaft 8, and a support member 10 for fixing the shaft 8 and a guide shaft 9 thereto.

Spring means 11 is disposed between the support member 6 and the support member 10 of the image fixing block C.

As can be seen from FIG. 1 and FIG. 3, side plates 12 are fixed by screws 13 to the opposite sides of the support member 6. Furthermore, between the side plates 12, there is secured a spacer rod 14 for keeping the space between the side plates 12 constant by the screws 13.

Referring to FIG. 2, a groove 15 is formed in a lower portion of each side plate 12, and the shaft 8 and the shaft 9 of the image fixing block C are engaged with each groove 15 in such a manner that the image fixing block C can moved up and down along the groove 15.

The thus constructed image fixing unit A is assembled between the image fixing bar 2 and the guide bar 3 by inserting the spring means 11, while depressed, between the image fixing bar 2 and the guide bar 3, whereby the guide blocks B are brought into pressure contact with the guide rod 3, while the image fixing block C is brought into pressure contact with the image fixing bar 2.

Figure 4:
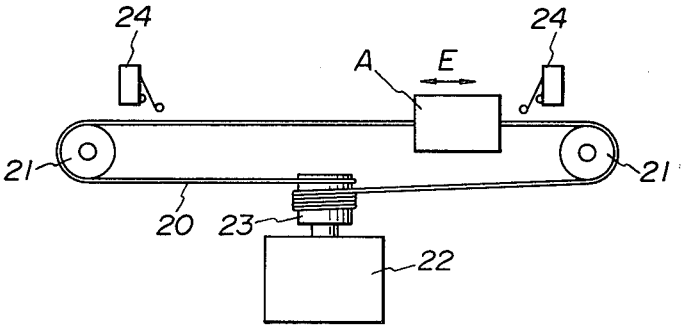
FIG. 4 is a diagrammatical view of a drive apparatus for driving an image fixing unit for use in the present invention.

Referring to FIG. 4, there is shown a mechanism for reciprocating the image fixing unit A in a predetermined range of the image fixing bar 2 and the guide bar 3. In this mechanism, a wire 20 is attached to an image fixing unit A and the opposite ends of the wire 20 are wound around a take-up drum 23 attached to an output shaft of a motor 22 through guide pulleys 21. Furthermore, in the opposite sides of the reciprocating range of the image fixing unit A, there are disposed limit switches 24 in such a manner that when the image fixing unit A turns on any of the limit switches 24, the actuation of the motor 22 and a drive motor (not shown) for moving the recording medium 1 are controlled.

In the thus constructed image fixing apparatus, the recording medium 1 is set in an image fixing section as shown in FIGS. 1, 2 and 3 and when an instruction for starting image fixing is given, the motor 22 of FIG. 4 is actuated and the image fixing unit A is driven from one side to the other side, whereby the image fixing unit A is moved along the image fixing bar 2 in one direction and applies a predetermined pressure to a portion of the recording medium 1 on the image fixing bar 2 so that pressure image fixing is performed. When the image fixing unit A reaches the other end, the limit switch 24 is actuated and the motor 22 makes a reverse rotation, whereby the image fixing unit A is driven and moved back in the direction of its first position and applies pressure again to the same portion of the recording medium 1 on the image fixing bar 2. When the image fixing unit A finishes one cycle of pressure application image fixing and returns to its first position after having reciprocated over the same portion of the recording medium 1, the limit switch 24 in the first position is actuated and in accordance with the actuation of the limit switch 24, a recording medium drive apparatus (not shown) is actuated and the recording medium 1 is moved by a predetermined distance in the direction of the arrow D as shown in FIG. 1, which is almost normal to the image fixing bar 2 and at the same time, the motor 22 is actuated and the image fixing unit A is again actuated and the above-mentioned reciprocating motion is repeated.

Since the image fixing is performed by reciprocating the image fixing unit A along the image fixing bar 2 in the direction almost normal to the moving direction of the recording medium 1, that is, in the direction of the arrow E in FIG. 2, it is unnecessary to apply a uniform pressure all over the recording medium in the width direction thereof unlike the conventional image fixing apparatus, and therefore the image fixing pressure to be applied to the image fixing roller 7 can be reduced and a less force is required to move the image fixing unit A.

For example, when an image fixing with pressure application was performed two times in the same portion of the recording medium 1 by an image fixing roller with a 19 mm outer diameter and 10 mm width, while the recording medium 1 was transported intermittently with an interval of 5 mm, a uniform image fixing was performed all over the recording medium 1 with application of a pressure in the range of 40 to 50 kg to the image fixing roller. In this experiment, the image fixing pressure was reduced to 1/10 or less of the conventional image fixing pressure, so that the driving force required for the image fixing apparatus or the image fixing unit A was also reduced and even when the image fixing unit A ran on the image fixing bar 2, the necessary driving force was several kg and when the image fixing unit A was moved along the image fixing bar 2, the necessary driving force for the image fixing was found to be in the range of 300 g to 500 g and therefore, in comparison with the conventional image fixing apparatus, the required driving force was significantly reduced.

Furthermore, as to the accuracy of each part or element for the image fixing apparatus, only the surface accuracy of the image fixing bar 2 is required so long as ball bearings or the like are utilized between the image fixing roller 7 and the shaft 8, so that the image fixing unit A can be made inexpensively. Furthermore, in this embodiment, since the variation of the finish accuracy of each part or the flexture thereof can be absorbed by the spring means 11, uniform pressure image fixing is performed constantly.

In the above-mentioned embodiment, image fixing was performed using the 10 mm wide image fixing roller while transportating the recording medium 1 intermittently with the interval of 5 mm and the image fixing was performed two times in the same portion of the recording medium 1. However, the width of the image fixing roller and the interval for transportating the recording medium 1 can be set as desired. Furthermore, the times of performing the image fixing in the same portion of the recording medium 1 can be set as required, and the image fixing can be performed by moving the recording medium 1 and the image fixing roller simultaneously.

Furthermore, in the above-mentioned embodiment, the wire 20 was employed in the mechanism for reciprocating the image fixing unit. However, instead of the wire 20, a belt, worm, rack or the like can be employed. Furthermore, instead of using the limit switches, the image fixing unit A can be reciprocated by applying a program signal to a drive motor for driving the image fixing unit A so as to drive the drive motor normally or reversely with a predetermined pattern.

What is claimed is:

1. A pressure application type image fixing method, by use of an image fixing apparatus comprising a drive means for transporting a recording medium in a predetermined direction and a pressure application means for applying a predetermined pressure to said recording medium, comprising the steps of:

reciprocating said pressure application means in the direction substantially normal to the transporting direction of said recording means, across part of said recording medium at each reciprocation; and transporting said recording medium in said predetermined direction sequentially in synchronization with the reciprocation of said pressure application means, whereby pressures applied sequentially to said recording medium across the whole thereof and developer deposited on said recording medium being permanently fixed thereto.

2. A pressure application type image fixing apparatus comprising;

a drive means for transporting a recording medium in a predetermined direction;

an image fixing bar disposed in the direction normal to the moving direction of said recording medium;

an image fixing roller which is rotatably supported against said image fixing bar;

spring means for bringing said image fixing roller into pressure contact with said image fixing bar; and drive control means for reciprocating said image fixing roller in a predetermined range along said image fixing bar, allowing said recording material to pass between said image fixing bar and said image fixing roller and applying pressure sequentially to said recording medium across the whole area thereof, whereby developer deposited on said recording medium is permanently fixed thereto.

3. A pressure application type image fixing apparatus as claimed in claim 2, wherein said drive means is moved intermittently, thereby transporting said recording medium intermittently.

4. A pressure application type image fixing apparatus as claimed in claim 2, wherein said image fixing roller is movably supported by a guide block having a plurality of guide rollers which are supported rotatably and movably along a guide bar.

5. A pressure application type image fixing apparatus as claimed in claim 3, wherein said pressure application type image fixing apparatus is for use in a facsimile apparatus.

6. A pressure application type image fixing apparatus as claimed in claim 4, wherein said guide bar comprises a rod member whose cross section is circular and said plurality of guide rollers are disposed in contact with said guide bar in such a manner that the shafts of said guide rollers are directed to form a right angle with each other.

* * * * *